US007360671B2

(12) United States Patent
Slade

(10) Patent No.: US 7,360,671 B2
(45) Date of Patent: Apr. 22, 2008

(54) LIQUID RESERVOIRS

(76) Inventor: Brian Slade, 20 Star Road, Ashford, Kent (GB) TN24 0DX ( * ) Notice: Subject to any disclaimer, the term of this patent is extended or adjusted under 35 U.S.C. 154(b) by 652 days.

(21) Appl. No.: 10/257,317

(22) PCT Filed: Apr. 6, 2001

(86) PCT No.: PCT/GB01/01602

§ 371 (c)(1),
(2), (4) Date: Feb. 6, 2003

(87) PCT Pub. No.: WO01/77004

PCT Pub. Date: Oct. 18, 2001

(65) Prior Publication Data

US 2003/0150518 A1 Aug. 14, 2003

(30) Foreign Application Priority Data

Apr. 11, 2000 (EP) ..... 00303037

(51) Int. Cl.
*B67D 3/00* (2006.01)

(52) U.S. Cl. ..... 222/187; 222/81; 222/541.2; 137/583; 137/587; 220/367.1; 220/745; 239/34; 239/44; 239/145

(58) Field of Classification Search ..... 222/80, 222/81, 83, 89, 91, 152, 153.01, 153.06, 222/153.05, 187, 189.06, 189.1, 204, 335, 222/464.1, 478, 185.1, 181.1, 416, 541.2, 222/541.8; 239/44, 34, 43, 145, 326, 45; 137/583, 587, 588; 220/580, 367.1, 745, 220/913, DIG. 27

See application file for complete search history.

(56) References Cited

U.S. PATENT DOCUMENTS

| | | | | |
|---|---|---|---|---|
| 1,938,151 | A | 12/1933 | O'Connor | |
| 3,862,701 | A * | 1/1975 | Strunc et al. | 220/227 |
| 4,121,507 | A | 10/1978 | Kuckens | |
| 4,982,875 | A * | 1/1991 | Pozzi et al. | 222/83 |
| 5,971,009 | A * | 10/1999 | Schuetz et al. | 137/312 |
| 6,708,897 | B1 * | 3/2004 | Hart et al. | 239/45 |

FOREIGN PATENT DOCUMENTS

| | | |
|---|---|---|
| DE | 44 33 954 A1 | 3/1996 |
| EP | 0 203 744 | 12/1986 |
| WO | WO 01/23008 A1 * | 4/2001 |

* cited by examiner

*Primary Examiner*—Frederick C. Nicolas
(74) *Attorney, Agent, or Firm*—Pillsbury Winthrop Shaw Pittman LLP

(57) ABSTRACT

A liquid reservoir comprising a container (20) forming a chamber for holding the liquid (27). The container has a top wall (23) that closes the upper end of the chamber, a liquid outlet (35) in fluid communication with a lower en d of the chamber, and an air supply duct (47) through which air can enter the lower end of the chamber. In use, the reservoir finds an equilibrium position in which, due to a reduction in pressure in an air space (29) formed above the liquid (27) at the closed, upper end of the chamber, the column of liquid in the chamber is supported by atmospheric pressure acting at the opening of the air supply duct (47) to the lower end of the chamber. This opening is achieved by breaking a frangible seal (32) across the duct (47) by the axial insertion of the liquid outlet (35). While the seal was unbroken the container offered a self-contained capsule of liquid for replacement fitting with the liquid outlet portion.

9 Claims, 9 Drawing Sheets

LIQUID RESERVOIRS

CROSS REFERENCE TO RELATED APPLICATIONS

This application is the national phase of PCT/GB2001/01602, filed Apr. 6, 2001, which claims priority to European patent application 00303037.6, filed Apr. 11, 2000, both of which are incorporated by reference in their entirety.

The present invention relates to reservoirs for liquids, in particular, although not necessarily exclusively to reservoirs for supplying a liquid at a constant flow rate and/or on the demand of a load.

One known form of liquid reservoir system works on the so called "chicken-feeder" principle. A main reservoir containing the liquid has an outlet conduit in its base and is otherwise closed. The outlet conduit opens into a secondary reservoir open to atmosphere at its top, such that atmospheric pressure acts on a free surface of liquid in the secondary reservoir. Liquid flows from the main reservoir through the outlet conduit into the secondary reservoir and air is drawn into the main reservoir through the same conduit. Once the liquid level in the secondary reservoir rises to cover the end of the outlet conduit, it is no longer possible for air to be drawn back into the main reservoir to replace the liquid flowing from it. Consequently, there is a drop in pressure in the air space at the closed upper end of the main reservoir and the system quickly reaches a state of equilibrium where the head of liquid in the main reservoir is balanced by atmospheric pressure acting on the surface of the liquid in the secondary reservoir, and the flow of liquid from the main reservoir ceases.

In use, when liquid is drawn from the secondary reservoir, the outlet conduit is uncovered once more, air can again be drawn into the main reservoir and flow commences, to top up the secondary reservoir. In this manner, a substantially constant head of liquid is maintained in the secondary reservoir.

This basic "chicken-feeder" arrangement is, however, rather unwieldy and relatively complex to manufacture as a consequence of the need for two reservoirs and the connection between them. It is also necessary to shield the free surface of the liquid in the secondary reservoir when it is desired to prevent human contact with the liquid, for example because it comprises a toxic or other potentially harmful substance. An example of this (though not for a toxic liquid) is seen in WO-A-96/14788, which is equivalent to U.S. Pat. No. 5,590,817, where the secondary reservoir is in the form of a cup positioned round and below a liquid outlet at the bottom of a flexible closed chamber.

In EP-A-0203744 a dynamic device for dispensing syrups has a permanently open mouth in the floor of a container. The container is fillable through a removable lid which is then sealed in airtight manner to the container. There is an air bleed hole in the lid, the size of which determines the rate at which syrup may pass out of the mouth. The bleed hole communicates with a tube which terminates above the mouth: this structure does not give a constant head.

In contrast, the invention provides an essentially constant-head liquid reservoir. It has a chamber for holding liquid and being for orientation in use with an upper end and a lower end, the chamber having a closed upper end, and an air inlet duct with an upper end at the upper end of the chamber and extending through the chamber to a lower end of the duct through which air can enter the lower end of the chamber. To obtain the constant-head effect, the liquid outlet from the chamber is above the level of the bottom of the air inlet duct.

The invention also provides a liquid reservoir having a chamber with an upper and a lower end, an internal duct communicating to the outside of the chamber at the upper end, the chamber containing liquid, a frangible seal preventing egress of the liquid through the internal duct and closing the chamber, a liquid outlet portion separate from the chamber, the liquid outlet portion having a liquid output duct, the outlet portion and the chamber being complable together such that the liquid outlet duct can break the frangible seal and contact the liquid at a level below that of the lower end of the internal duct; and a cartridge containing liquid and comprising a closed chamber with two ends, an internal duct in the chamber leading from one of the two ends, where it is open to the outside of the chamber, to adjacent the other of the two ends, and a frangible seal across the duct and closing the chamber against egress of liquid.

In a similar manner to the traditional "chicken-feeder" those reservoirs find an equilibrium position in which, due to a reduction in pressure in an air space formed above the liquid at the closed, upper end of the chamber, the column of liquid in the chamber is supported by atmospheric pressure acting at the liquid/air interface present at the opening of the air supply port to the lower end of the chamber, as explained in more detail below. This is especially valuable for fragrances because of the comparatively small air volume that is found above the level of the liquid; there is less opportunity for fractionation of different elements of the fragrance into the air with consequential distortion of the perceived effect of the fragrance when dispensed.

The relative positioning of the ports may be selected to give some control over the characteristics of the device. For example, if the liquid outlet from the container is no lower than the lower end of the air conduit where it opens into the chamber and is a simple open port, no liquid will flow from the container through the outlet port under equilibrium conditions.

Thus, in one form of the device having separate liquid outlet and air inlet, the outlet and the lower end of the air conduit are disposed substantially at the same level as one another in the container. In this manner, the hydrostatic pressure at the outlet will be substantially equal to the atmospheric (i.e. ambient) pressure outside the container, ensuring that no flow takes place until demanded by e.g. a load connected to the outlet. However, the outlet from the container may be in a wick or other device which raises the liquid from the lower end of the container.

In any case, the "chicken feeder" effect assists a regular and controlled rate of output which may both be more linear, and at a lower level, than has been possible in the past.

Then, a volatile liquid, as for an air freshener, may be led to an emanator from which it will evaporate. This may be a simple exposed wick, but preferably is a porous or high-surface-area member which lies mainly below the level at which it is fed from the outlet. In this way "heavy" fragrance elements, which tend to be of lower volatility than "top note" elements, are swept chromatographically over the emanator giving a maximum area for their dispersion into the atmosphere and hence a more level and true effect.

To compensate for temperature variations, which it has been found can give rise to a significant expansion in the volume of the air pocket trapped at the upper end of the chamber, means are preferably provided to accommodate liquid displaced as a result of this expansion.

Embodiments of the invention are described below, by way of example, with reference to the accompanying drawings, in which.

Figure 1:
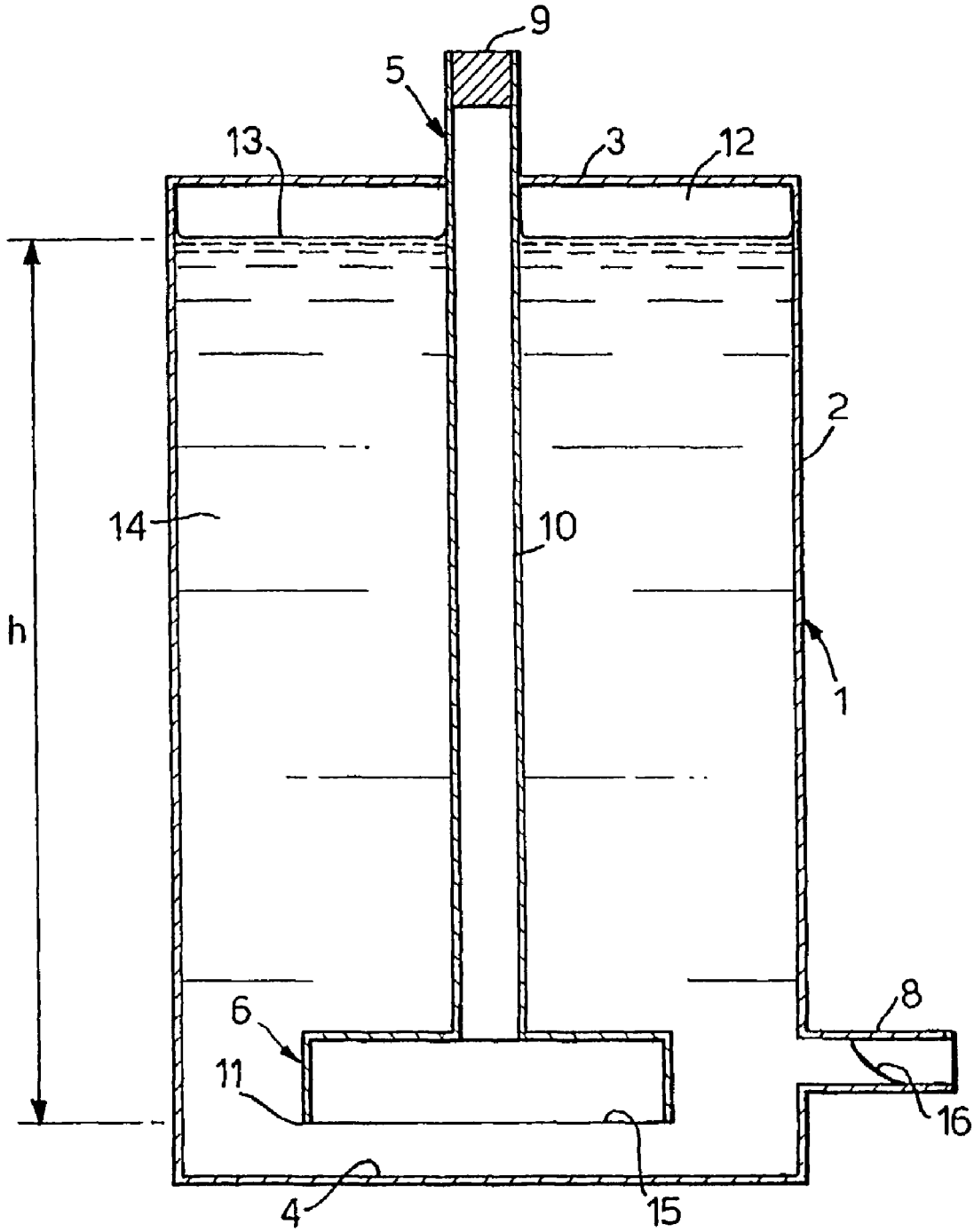
FIG. 1 is a diametrical cross-section of a reservoir in accordance with a first embodiment of the invention.

Referring initially to FIG. 1, the main structure of the reservoir in the illustrated example is formed by an essentially rigid cylindrical container 1. The container 1 has closed, circular top and bottom end walls 3,4 joined by a cylindrical side wall 2. Near the base of the container 1, an outlet port 8 is formed in the side wall 2, through which liquid held in the container 1 can be drawn out.

An air supply conduit 5 extends through the reservoir, and in this example is disposed centrally, coaxially with the axis of the cylindrical container 1. Normally, the axis of the container will be vertical or approximately so, in use. An upper end of this conduit 5 protrudes, in this embodiment, from the top wall 3 of the container 1 and is open to the surrounding atmosphere. An air permeable plug 9, for example a sintered element, is disposed in the opening at the upper end of the conduit. This plug 9 does not present any significant resistance to the passage of air through the conduit 5, but serves as a barrier to liquid.

The other end of the air supply conduit 5 opens into the interior of the container close to its base 4. As can be clearly seen in FIG. 1, the lower end of the air supply conduit terminates just below the level of the outlet 8 in the container side wall 2.

Although it is possible for the air supply conduit to have a constant cross-section along its entire length, the preferred configuration is that illustrated, in which there is an increase in the cross-sectional area of the conduit 5 towards its lower end. specifically, a portion 10 running for most of the length of the conduit 5 has a constant, circular cross-section of relatively small diameter. However, at its lower end there is a step increase in this cross-section so that the conduit 5 terminates in a considerably larger-diameter, cylindrical portion 6, also of circular section, and having a lower edge 11 forming the lower end of the duct.

The basic mode of the operation of the reservoir will now be explained, still referring to FIG. 1, which illustrates the reservoir in its fully charged equilibrium state. In this state, there is a small, sealed air space 12 at the upper end of the container 1 formed between the surface 13 of liquid 14 in the container 1 and the top wall 3 and side wall 2 of the container.

The air in this space 12 is at below atmospheric pressure. Specifically, in the equilibrium condition illustrated, the pressure in this space is equal to atmospheric pressure less the hydrostatic pressure attributable to the head (h) of liquid 14 above the lowest edge 11 of portion 6 of the air supply conduit 5 where it opens into the reservoir. The air supply conduit 5 is, as mentioned above, effectively open to atmosphere at its upper end, which of course means that the air in this conduit is at atmospheric pressure. In this way, atmospheric pressure acts on the surface 15 of the liquid 14 at the air/liquid interface at the lower end of the air supply conduit. Thus, a pressure balance is achieved between atmospheric pressure acting at this liquid/air interface formed at surface 15 on the one hand, and the below-atmospheric pressure in air space 12 combined with the hydrostatic pressure due to the head (h) of liquid 14 above the liquid/air interface 15 on the other. In this equilibrium state, the relative levels of the two free liquid surfaces, namely the surface 13 at air space 12 and the surface 15 at the lower end of the air conduit 5, are maintained.

Significantly, since there is atmospheric pressure acting at the liquid/air interface at surface 15 at the lower end of the air supply conduit 5, then in the equilibrium condition shown the hydrostatic pressure of the liquid at the level of this interface is equal to atmospheric pressure. By locating the outlet 8 from the reservoir substantially at the same level as the lower edge of the air conduit but slightly above it, as illustrated, a balance is also achieved between the hydrostatic pressure of the liquid at this outlet 8 and atmospheric pressure acting at the outer end of the outlet 8. Consequently, there is no flow of liquid through the outlet until some external force is applied to upset this equilibrium.

As seen in FIG. 1, in this equilibrium state, the liquid surface 16 at liquid/air interface in the reservoir outlet 8 forms a meniscus which, due to the combined effects of adhesion of the liquid to the interior wall of the outlet port 8, gravity and atmospheric pressure, is concavely curved with its lower end projecting further along the outlet port 8 than its upper end.

To prime the reservoir initially, in order to set up the equilibrium condition described above, it can be inverted and filled either through the outlet 8 (as in the illustrated example) or a sealable filling port may be provided at or near the lower end of the container for this purpose. The container 1 is inverted and can be filled up to the level of the lower end 11 of the air supply conduit (which of course is uppermost during inversion). During this operation it is preferable to avoid any liquid entering the air supply conduit 5, but any liquid that should inadvertently find its ways into the conduit 5 is retained in the reservoir by virtue of the plug 9. Once the container has been filled, it is turned back to its upright orientation (seen in the Figures) creating the space 12 at the top of the container 1, giving rise to the equilibrium condition in the manner already explained.

Let us now assume that a quantity of liquid is drawn off at the outlet 8. This will cause a drop in the level of the liquid surface 13 at the top of the container 1. This results in an increase of the volume of the sealed air space 12 and a consequential drop in the air pressure in this space 12. This in turn creates an imbalance between the pressures acting on the two free liquid surfaces 13,15 within the reservoir. This imbalance causes air to flow into the container 1 through the air supply conduit 5, the air passing into the container around the lower edge of the enlarged lower end 11 of the conduit to bubble upwardly through the liquid 14 to the air space 12—see FIG. 2—to increase the pressure in that space until an equilibrium is once again restored.

Once the equilibrium is restored, the hydrostatic pressure of the liquid at the level of the lower end 11 of the air supply conduit 5, and hence at the level of the reservoir outlet 8, is equal to atmospheric pressure once more.

It will be appreciated, therefore, that the reservoir in effect presents a substantially constant hydrostatic pressure at its outlet 8 (in this case equal to atmospheric pressure, that is to say the pressure of the local environment surrounding the device) irrespective of the level of the liquid in the container. In this sense, it is similar in effect to the traditional "chicken-feeder" design discussed above, but achieves this effect in a very compact, less complex device. What is more, since the only liquid surface exposed to the outside of the device is that of the meniscus at the outlet 8, the device is inherently safer than the "chicken-feeder" with its exposed secondary reservoir, and can therefore be more readily used in systems for dispensing toxic or otherwise hazardous liquids.

One factor which has been found to disturb the equilibrium of the fluid air system in embodiments of the reservoir of the present invention is temperature. Specifically, with a rise in ambient temperature the liquid, and to a much greater extent the air trapped in air space 12, will expand. This expansion, in particular of air in space 12, is accommodated by the liquid moving part way up the air supply conduit 5. If this conduit 5 were of a relatively small diameter along its entire length, the displaced liquid would be driven a considerable distance up the conduit 5. This in turn could create a significant head of liquid in the conduit 5 above the level of the outlet 8, causing an undesired flow of liquid through this outlet 8.

However, in the illustrated embodiment, the liquid displaced as a result of a temperature change is accommodated in the much larger diameter, lowermost portion 6 of the conduit 5. In this way, the displaced liquid only causes a very small rise of the level of the air/liquid interface 15 at the lower end 11 of the air conduit 5, creating only a negligible increase in the hydrostatic pressure at the outlet 8, and the undesirable effect of the temperature rise is thus negated or at least made minimal.

In this example the diameter of the enlarged lower end of the conduit is about 5 times that of the upper portion of the conduit. Generally, however, the cross-sectional area of the lower end can be selected depending on the variation in temperature that the reservoir can be expected to undergo, in order to accommodate the resulting expansion without a significant rise in the liquid head. Typically, the cross-sectional area at the lower end will be at least 10 times, or better still 20 times greater than the area at the upper end.

Other temperature compensation measures may be employed as an alternative to the enlarged lower end of the air supply conduit, or to supplement it. For instance, one or more ballast tubes may be provided, these tubes opening into the chamber substantially at the level at which the air supply port opens into the chamber, and being open to atmosphere at their other, upper end. In this way, the displaced liquid rises up these tubes as well as the air conduit. The effect is similar, in that the volume of liquid displaced is spread across a wider cross-sectional area, minimising the rise in liquid head in the air supply conduit.

Figure 2:
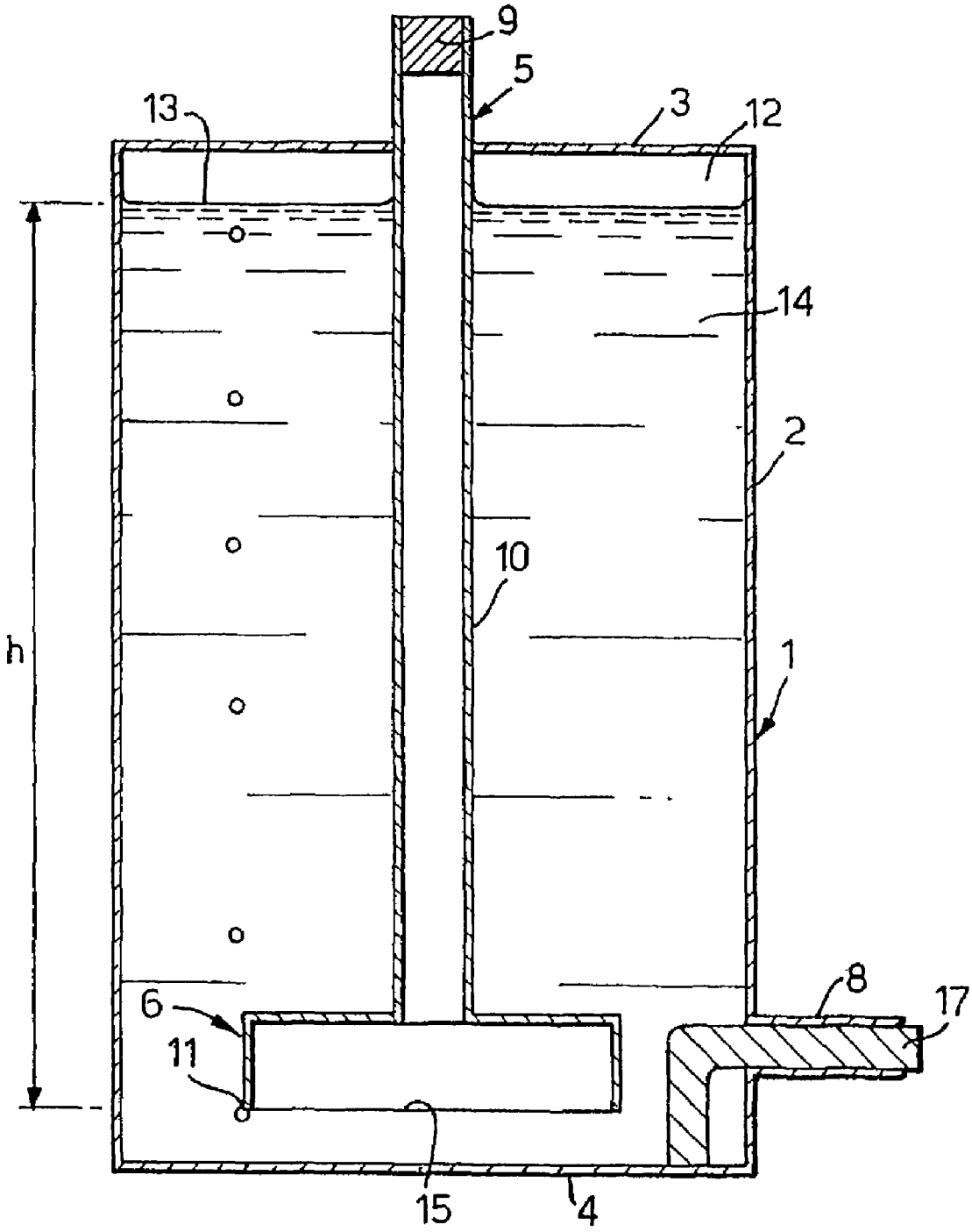
FIGS. 2, 3 and 4 illustrate three alternative arrangements for extracting liquid from the reservoir of FIG. 1.
Figure 3:
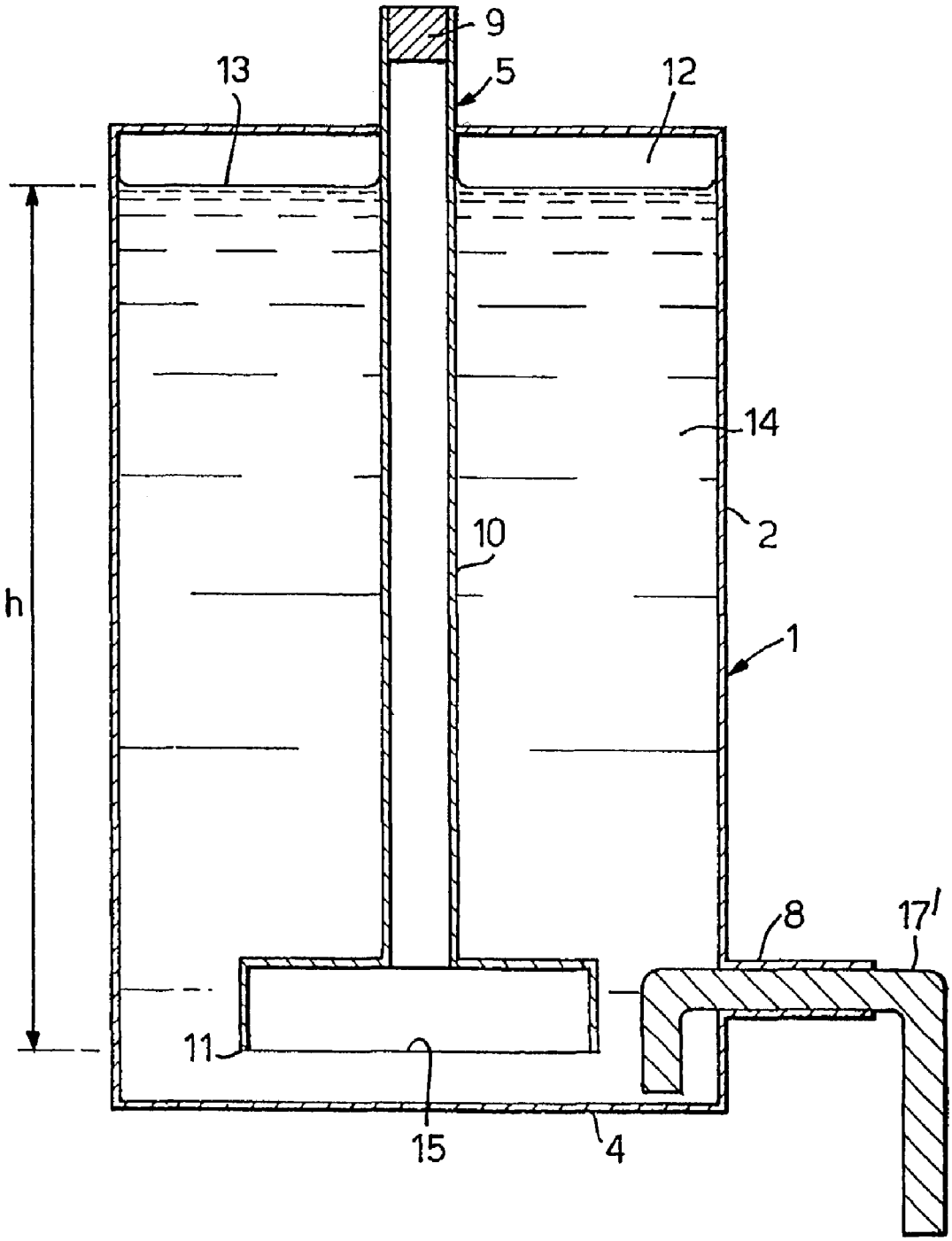
Figure 4:
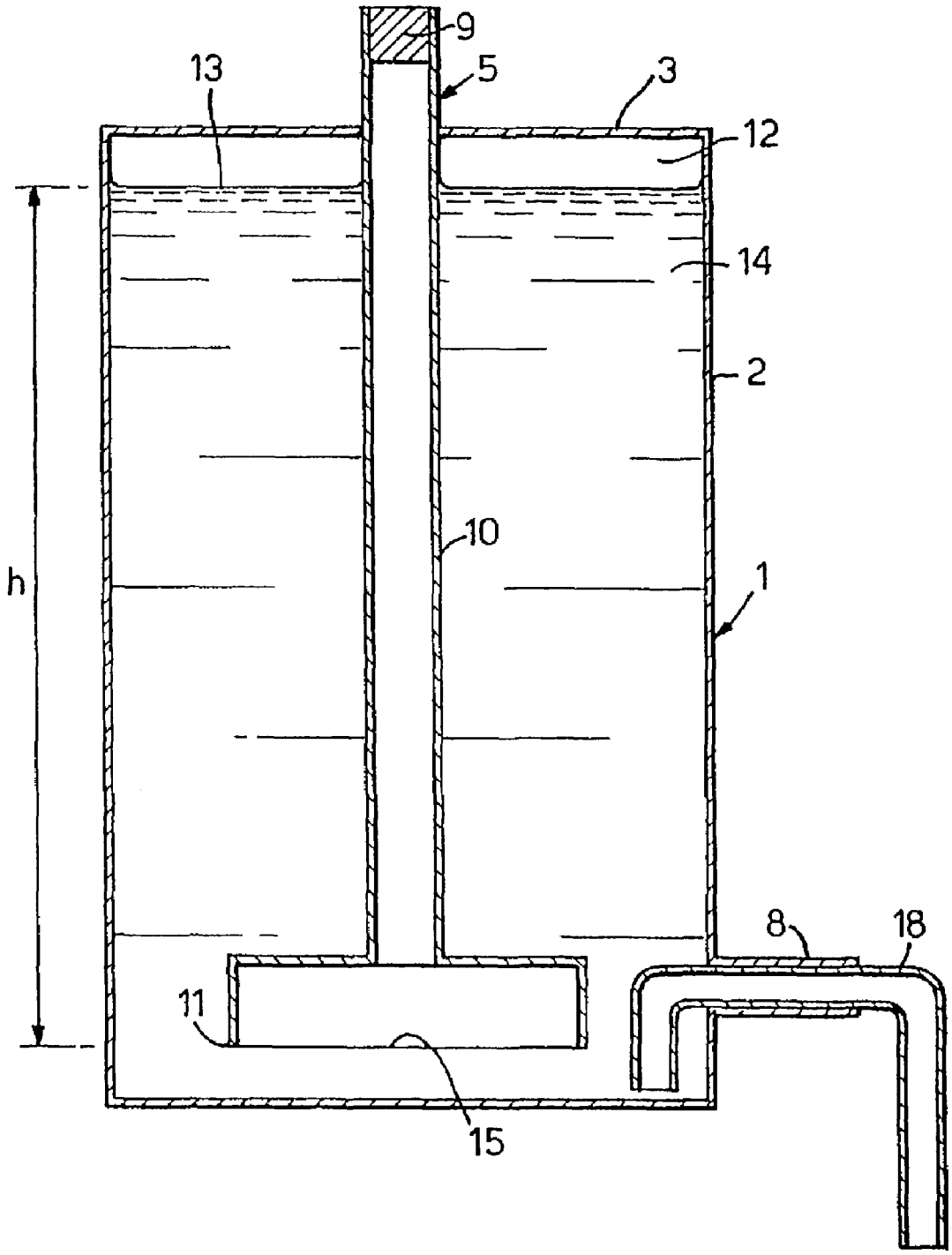

Turning now to FIGS. 2 to 4, three alternative mechanisms for drawing liquid off at the outlet 8 of the reservoir will be described. In the arrangement illustrated in FIG. 2, a short length of a capillary material (for instance a fibrous or porous material) is received in the outlet port 8 of the reservoir to serve as a wick 17. The wick 17 extends through the outlet 8 and, the portion of the wick inside the container 1 being turned downwardly towards the base 4 of the container. The other, outer end of the wick 17 protrudes slightly from the outlet port where it terminates at the same level as the outlet itself.

In use, liquid from the reservoir is drawn into the wick by capillary action until the wick becomes saturated, at which point the flow stops. If subsequently an external load is connected to the wick to draw liquid from it, or liquid is drawn from the wick in any other manner, flow will commence, only to stop again as soon as the load is removed. This arrangement therefor relies primarily on capillary action to deliver liquid from the reservoir outlet to a load.

The container body is essentially rigid; that is, it is not intended to allow or cause descent of liquid by becoming deformed or being squeezed.

FIG. 3 shows an alternative arrangement, using a slightly modified wick 17'. In particular, rather than the outer end of the wick terminating at the level of the reservoir outlet 8, similarly to the inner end of the wick, the outer end is turned downwardly and extends to a level well below that outlet 8.

This modified wick 17' therefore serves in the manner of a siphon to draw liquid from the reservoir. What is more, the siphon is self-priming, the capillary nature of the wick drawing liquid from the reservoir along its length to initiate the siphon effect. Once the siphon is flowing, liquid is drawn off from the reservoir at a constant flow rate due to the constant hydrostatic pressure maintained at the outlet 8 by virtue of the design of the reservoir.

FIG. 4 illustrates a further alternative for drawing liquid from the reservoir, which employs a simple siphon arrangement. A siphon tube 18 replaces the wick 17,17' seen in FIGS. 2 and 3 in the outlet port 8 of the reservoir. Again, once the flow through the siphon is started, it will continue at a substantially constant flow rate.

As will be readily appreciated, the reservoir has wide applicability and may be used to advantage in a great variety of applications. The reservoir is particularly useful for applications where there is a desire to provide a constant flow rate to a 'load' or other element. For example, the reservoir can be used to supply a constant flow of a liquid fragrance to an emanating element from which the fragrance is dispersed into the surrounding environment, e.g. a screen of the form described in co-pending WO-A-01/66158.

Embodiments of the reservoir can also be advantageously employed where there is a desire to present a liquid in an easily accessible manner to an animal, whilst ensuring that the liquid does not escape from the reservoir until demanded by the animal. Such an arrangement might be useful, for example, for baiting poison, where it is clearly undesirable that the liquid should escape into the environment. An arrangement of the form illustrated in FIG. 2 would, for example, be appropriate for such applications, the animal being given access to the outer end of the wick 17. Alternatively, the outlet port 8 of the reservoir could be designed to allow access by the animal to the meniscus 16 of the liquid present in that port. For instance, the outer end of the port could be terminated in a small bowl of trough from which the liquid could be taken, the elongate base of the meniscus 16 extending into this bowl or trough for example.

A second embodiment is described with reference to FIGS. 5 to 8.

This has many features in common with the first, and in particular a feature of an inlet air conduit which extends coaxially through a rigid container of the reservoir, but it also has the important and inventive feature that the container and its liquid contents can form a cartridge-like sealed entity, a seal of which is broken by a discrete liquid output portion. Because of this, the liquid output portion may be completely separable from, and insertable into, replacement liquid containers.

Figure 5:
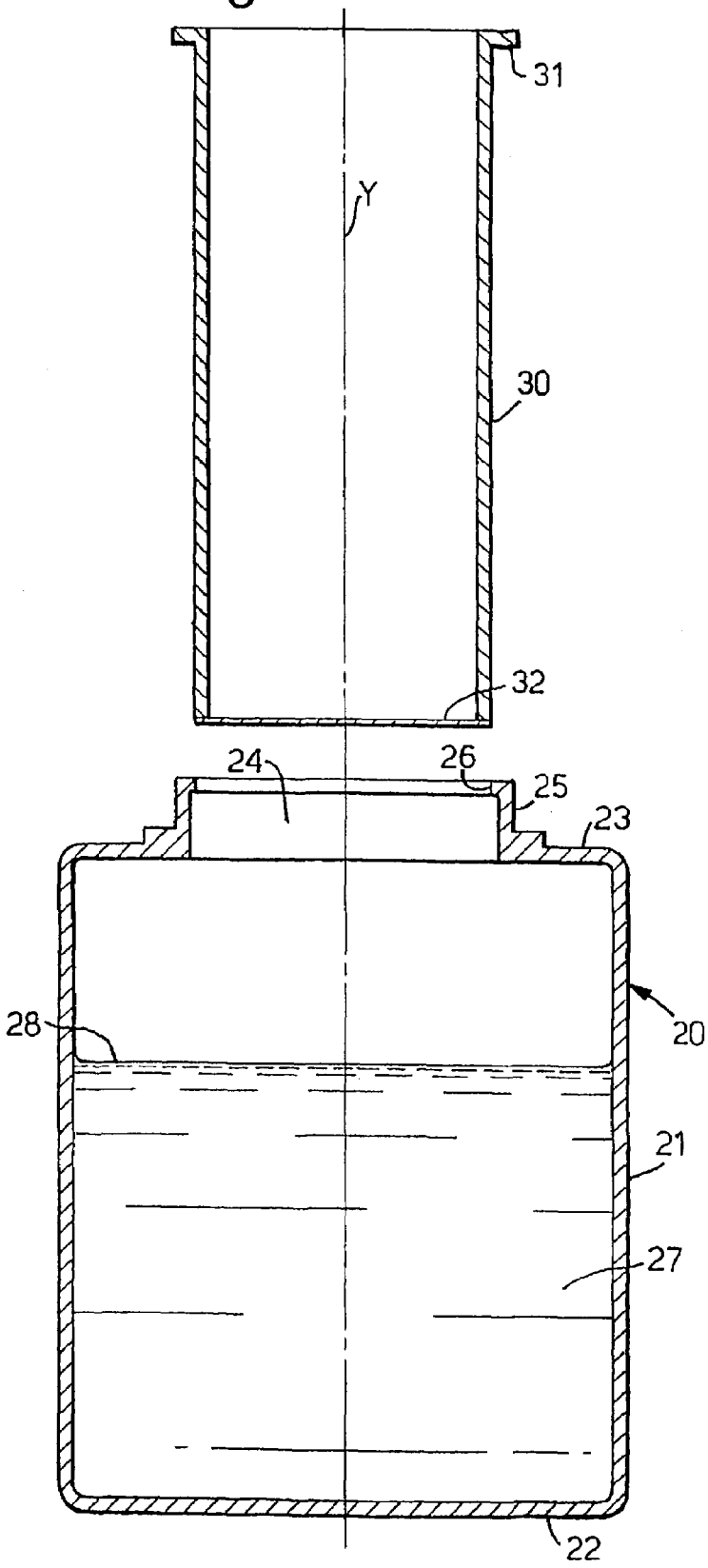
FIG. 5 shows an exploded diametrical cross-section of container parts of a second embodiment.

In FIG. 5, a container body 20 has a cylindrical wall 21 and a continuous lower floor 22, but an upper wall 23 is interrupted by aperture 24 defined by a cylindrical wall 25 with an inwardly extending lip 26. Liquid 27 is contained up to a level, for example, 28. An air inlet duct 30 is initially separate from the container. It is cylindrical to fit within the mouth formed by the lip 26 and has an outwardly directed flange 31 at its upper end. At its lower end 11' it is closed off by a seal in the form of a diaphragm 32 of a frangible material such as thin plastics or metal foil.

Figure 7:
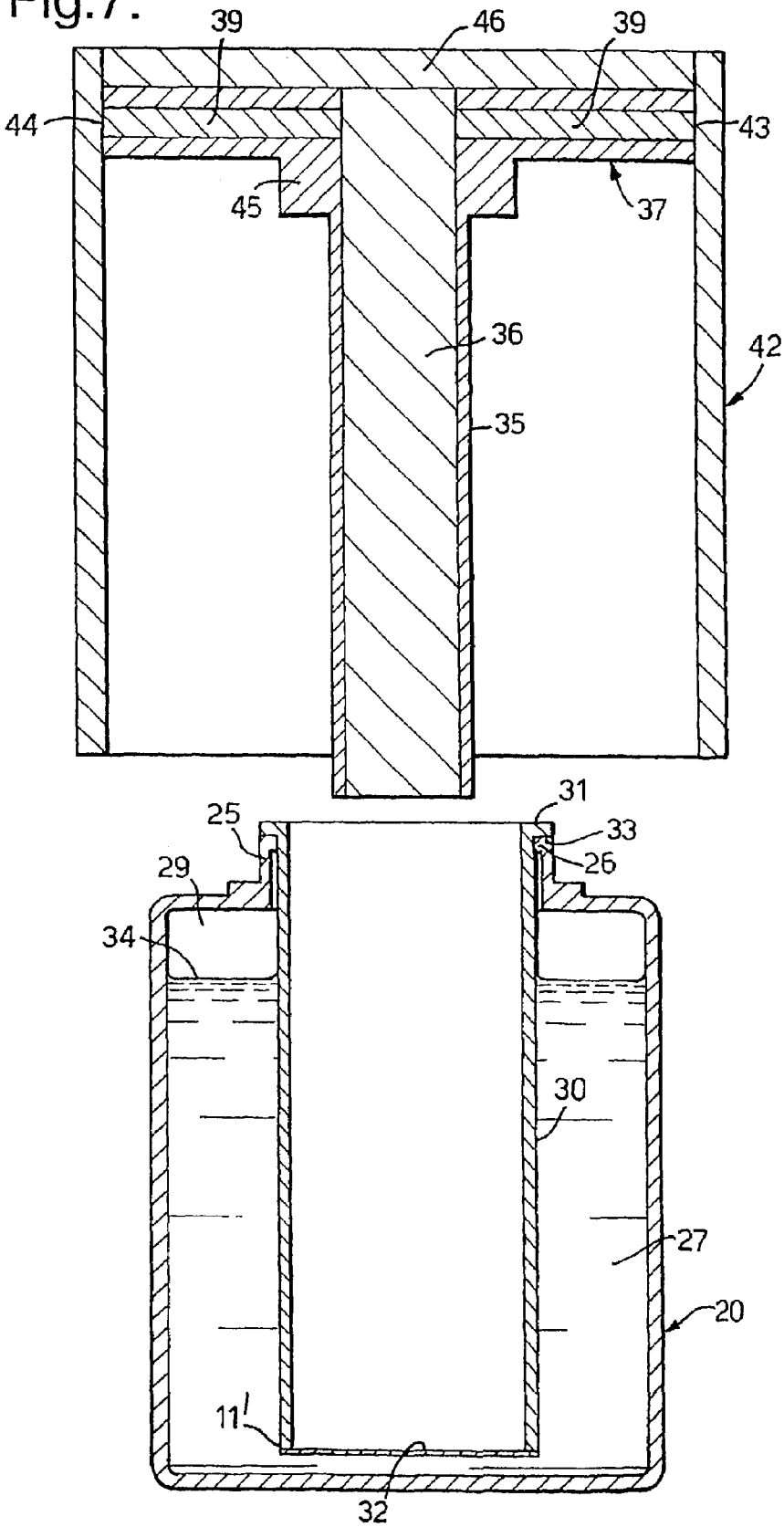
FIG. 7 shows an exploded diametrical cross-section of the above respectively assembled.

The container 20 and the duct 30 are then assembled together as seen in the lower part of FIG. 7, with adhesive sealant, or welding 33, at the interface between flange 31 and lip 26, so that the duct 30 and container 20 are coaxial on axis Y.

Seal 32 remains intact so that liquid 27 in the container is displaced to a level 34, air above the liquid being displaced progressively with the insertion of the duct 30 so that at the time of the formation of the seal at 33 pressure in air gap 29 below the upper wall 23 of the container is atmospheric. Thus we have, as seen in the lower part of FIG. 7, a self-contained cartridge-like sealed container of liquid 27. Of course, the container wall need not be cylindrical; it could be of any decorative shape.

For additional security, the cartridge may be sent out with a temporary closure or cap over the open upper end of the duct 30, the closure or cap fitting over the outside of the cylindrical wall 25.

Figure 6:
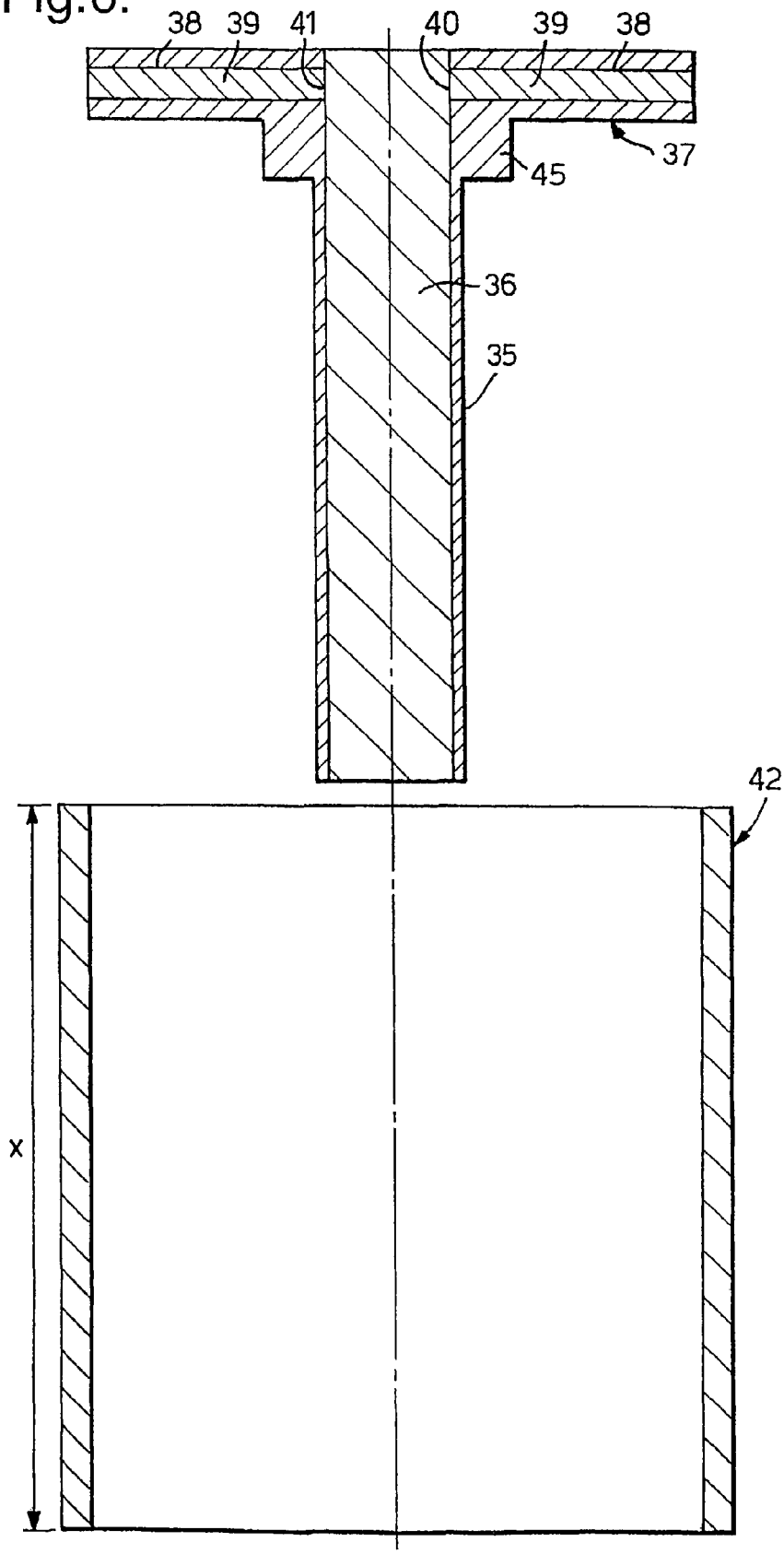
FIG. 6 shows an exploded diametrical cross-section of a liquid outlet portion of the second embodiment.

A liquid outlet portion of the second embodiment is seen firstly in FIG. 6.

An output tube 35 is a hollow cylinder filled with wicking material 36 which has a wicking action in the axial direction of the tube.

At the head of the tube 35 there is a circular head 37 of larger diameter than the tube and the container 20, with an annular ridge 45 at the junction between the tube and head.

Radial ports 38 distributed circumferentially around this head contain wicking material 39 arranged to wick in a horizontal (radial) direction. Alternatively an annular disc of wicking material may be used. In either case the wicking material is arranged so as to have intimate contact at interfaces 40,41 with the wicking material 36 in the output tube.

The liquid outlet portion will include also an emanator 42 which is a cylinder of cardboard, felt, papier maché or similar wicking material. It has an axial height x.

The outlet portion is assembled together as seen in the upper part of FIG. 7 showing how the emanator 42 fits tightly around the head 37 and is held there either by a force-fit, by adhesive, by pins or staples, or by indents formed in the tube to lodge above and/or below the head. Thus it is in intimate contact at 43 and 44 with the radially outer ends of wicking material 39 and a potential liquid path is set up by the wicking material all the way from the lowermost end of the tube 35 to the whole surface of the emanator 42.

A cap 46 is fitted over the top of the plate and within the uppermost edges of the emanator 42.

Figure 8:
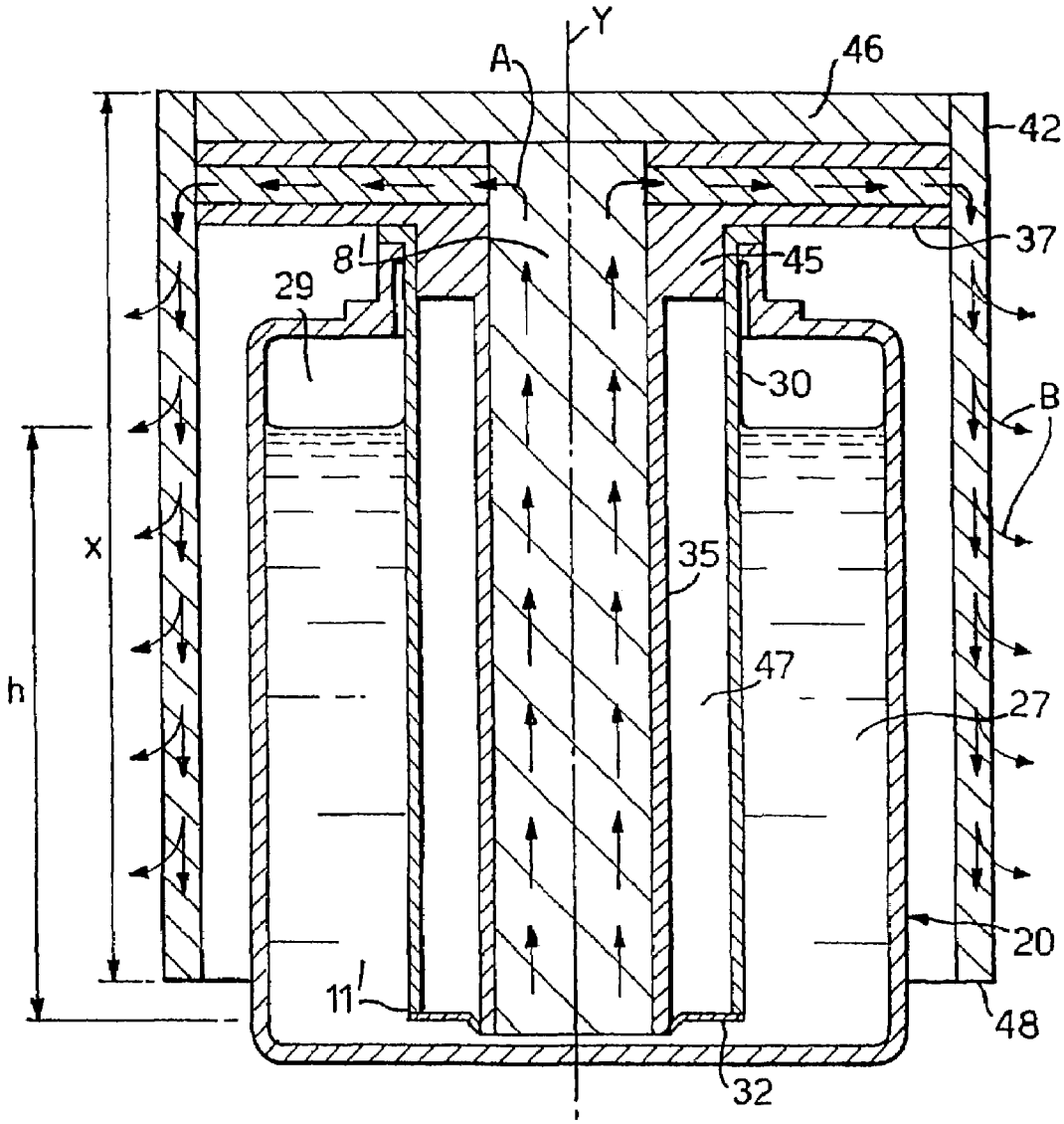
FIG. 8 shows in diametrical cross-section the second embodiment assembled.

FIG. 8 shows the assembled state of this reservoir.

The liquid outlet portion seen in the upper part of FIG. 7 is forced down the air inlet duct 30 of the container so that the lowermost end of tube 35 breaks the frangible seal 32. This may be assisted by a screw-threaded or bayonet-fitting engagement (not shown) between the portions. Thus, the lowermost end of wicking material 36 comes into contact with liquid 27 and wicking action indicated by arrows A can start. Liquid leaves the container at liquid outlet 81'.

The axial length of the tube 35 is such that when the plate 37 fits closely over the flange 31 of the air inlet tube the lower end of the tube 35 is near the floor of the container.

The annular ridge 45 fits within the uppermost end of the duct 30. However, it does not do so in an airtight fashion. As a result an annular air inlet conduit 47 formed between tubes 35 and 30 is maintained at ambient pressure. To assist this there may be grooves or ports in the ridge 45 and grooves in the upper surface of the flange 31.

The load on this reservoir is represented by the evaporation surface of the emanator 42 from which liquid evaporates as schematically indicated by arrows B.

By selection of the length x of the emanator 42 and/or of its setting in relation to the plate 37, the relationship of the bottom end 48 of the emanator with the bottom end of the tube 35 may be adjusted so as to regulate (either fixedly or variably) the rate of flow and hence of evaporation. If the end 48 went below the end of the tube 35 there would be a siphon established.

However, the effect of the construction of the reservoir and in particular the positioning of the air inlet duct 30 within it means that there is a substantially constant head, exactly in the manner as described for the first embodiment, of liquid pressure at the bottom of the tube 35. Bubbles to replenish the air gap 29 may escape at the broken edges of the seal 32.

A third embodiment shown in FIGS. 9 to 12 has an even more economical construction and yet has in common with the second embodiment that the air inlet tube is within the container and there is a frangible seal on a self-contained cartridge of liquid to be dispensed.

Figure 9:
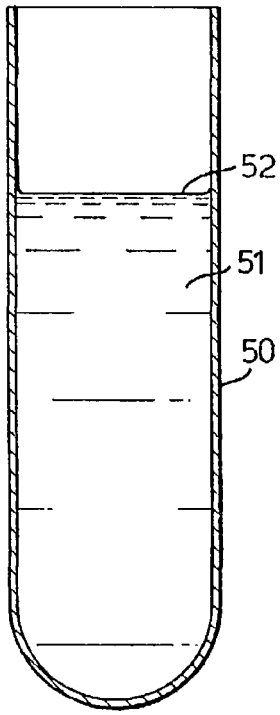
FIGS. 9 to 12 show in diametrical cross-section respective stages in the assembly of a third embodiment.

In FIG. 9 we see a container in the form of a vial 50 containing liquid 51 up to a level 52.

Figure 10:
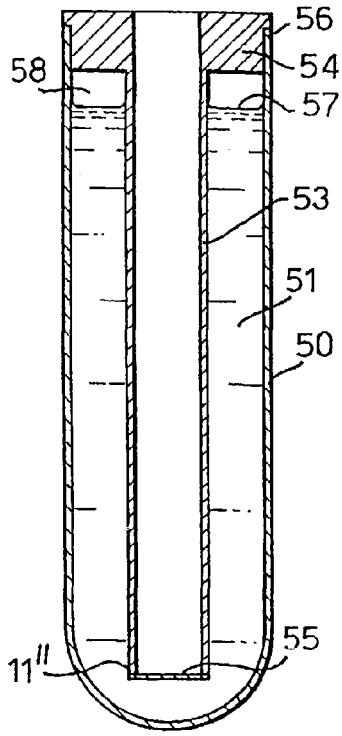

In FIG. 10 an air inlet duct 53 integral with or attached to a sealing bung 54 at its head and having a frangible seal 55 of plastics or metal foil at its lower end 11" is inserted into the vial and sealed to its upper end 56 by bung 54. Liquid 51 is displaced upwardly to level 57 by the insertion of the tube 53 leaving an air gap 58 at atmospheric pressure below the bung 54.

Figure 11:
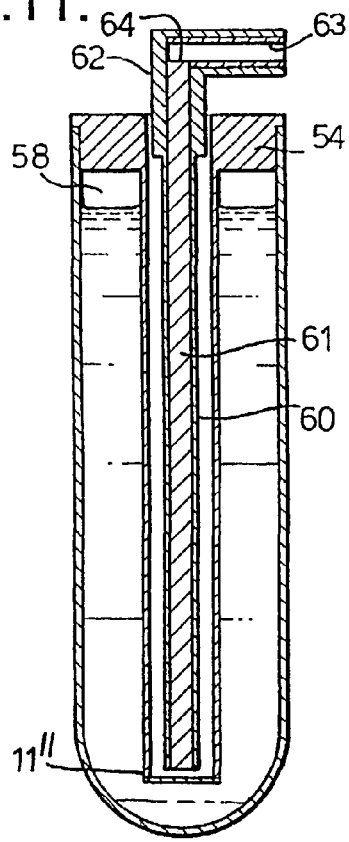
Figure 12:
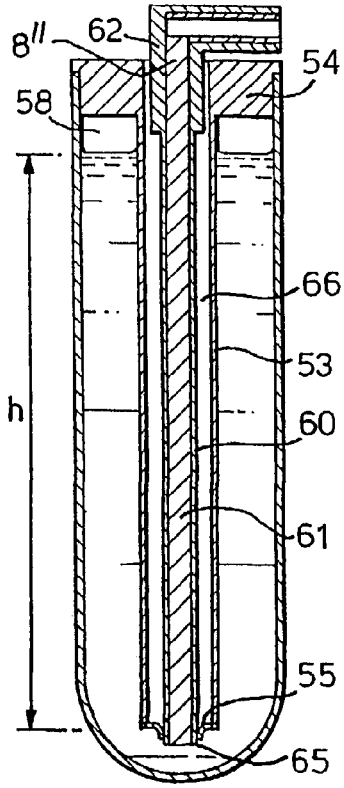

In FIG. 11 a liquid outlet portion is seen in the container but not yet communicating with the liquid.

The liquid outlet portion includes an output tube 60 which is filled with axially-acting wicking material 61. At its head the tube 60 has the axial arm of an L-shaped fitting 62, the radial arm of which is occupied with a tube 63 forming a socket by which a wick, siphon, emanator or the like—in particular a screen-type emanator as seen in my U.S. Pat. No. 6,631,891—may be brought into contact with and ultimately take liquid, which has left the chamber at outlet 8", from the top surface 64 of the wicking material 61. Alternatively, the arm 63 may have a capillary tube, wicking material or the like which will draw liquid, when available, radially away from the wicking material 61.

To activate the embodiment, the liquid outlet portion is pushed axially downwardly either directly or with the aid of screw-threading (not shown) so that the bottom end 65 of the tube 60 breaks the seal 55 and the wicking material 61 is brought into contact with liquid 51.

The axial arm of the coupling 62 is not a tight fit in the bung 54 such that an annular air inlet conduit 66 is formed between tubes 53 and 60. Air ingress may be assisted by axial grooves in the arm 62 and/or the bung 54.

These examples of possible applications for the reservoir are of course only some of a great many possibilities, and go some way to illustrating the applicability of the reservoir in many diverse applications. As such, they are intended to be illustrative rather than in any way limiting on the scope of the present application.

It will also be appreciated that many variations from the specifically described embodiments are possible.

The invention claimed is:

1. A liquid reservoir comprising:

a liquid holding chamber oriented in use with an upper end and a lower end, the chamber having a closed upper end, an air inlet duct with an upper end at the upper end of the chamber and extending through the chamber to a lower end of the duct through which air enters the lower end of the chamber, a liquid outlet from the chamber above the level of a lower end of the air inlet duct and communicable with liquid at a lower end portion of the chamber, wherein a substantially constant hydrostatic pressure is maintained at the liquid outlet, and discharge means via which said liquid is drawn out from the chamber through the liquid outlet, wherein said discharge means comprises a capillary element engaged in the liquid outlet to protrude into the chamber.

2. A liquid reservoir according to claim 1, wherein the liquid outlet is in an outlet portion which is separable from the chamber.

3. A liquid reservoir according to claim 1, wherein the liquid outlet is in an outlet portion which is movable in relation to the chamber to break a frangible seal in the air inlet duct.

4. A liquid reservoir according to claim 1, further comprising means for accommodating any of the liquid displaced as a result of expansion in the volume of an air pocket trapped between the closed, upper end of the chamber and the liquid therein.

5. A liquid reservoir according to claim 4, wherein said means for accommodating comprise a lower end portion of the air inlet duct having a greater cross-sectional area, measured normal to its axis, than the upper end.

6. A liquid reservoir according to claim 5, wherein said cross-sectional area of the air inlet duct at the lower end is at least 10 times greater than said cross-sectional area at the upper end.

7. A liquid reservoir according to claim 1, wherein the discharge means includes wicking means to draw the liquid upwardly out of the chamber.

8. A liquid reservoir according to claim 1, wherein the discharge means includes an emanator for evaporation of the liquid drawn from the chamber.

9. A liquid reservoir having a chamber with an upper and a lower end, said upper end being closed, an internal duct that provides communication an ambient pressure outside of the chamber at the upper end and extending at the lower end to a lower end portion of the chamber, the chamber containing liquid, a frangible seal preventing egress of the liquid through the internal duct and closing the chamber, a liquid outlet portion separate from the chamber, the liquid outlet portion having a liquid output duct, the liquid outlet portion and the chamber being coupled together such that the liquid output duct breaks the frangible seal and contact the liquid at a level below that of the lower end of the internal duct, said coupling maintaining the communication of the internal duct to the outside of the chamber whereby air in the internal duct is at the ambient pressure.

* * * * *